US005586864A

United States Patent [19]

Knorowski et al.

[11] Patent Number: 5,586,864

[45] Date of Patent: Dec. 24, 1996

[54] TURBINE NOZZLE DIAPHRAGM AND METHOD OF ASSEMBLY

[75] Inventors: Victor J. Knorowski, Rexford; George Reluzco; Kenneth J. Robertson, both of Schenectady; Paul L. Adamkoski, Amsterdam, all of N.Y.

[73] Assignee: General Electric Company, Schenectady, N.Y.

[21] Appl. No.: 395,357

[22] Filed: Feb. 27, 1995

Related U.S. Application Data

[63] Continuation-in-part of Ser. No. 280,899, Jul. 27, 1994, abandoned.

[51] Int. Cl.[6] ..... F04D 29/44

[52] U.S. Cl. ..... 415/209.2; 415/209.3

[58] Field of Search ..... 415/208.1, 209.2, 415/209.3, 209.4, 210.1, 191

[56] References Cited

U.S. PATENT DOCUMENTS

| | | |
|---|---|---|
| 961,329 | 6/1910 | Wait . |
| 1,298,564 | 3/1919 | Rice . |
| 1,717,203 | 6/1929 | Gottschalk . |
| 1,938,382 | 12/1933 | Haigh . |
| 2,079,473 | 5/1937 | Wade . |
| 2,110,679 | 3/1938 | Robinson . |
| 2,245,237 | 6/1941 | Truex . |
| 2,264,877 | 12/1941 | Haigh . |
| 2,771,622 | 11/1956 | Thorp, II . |
| 3,738,307 | 6/1973 | Jacobsen et al. . |
| 3,836,282 | 9/1974 | Mandelbaum et al. . |
| 3,909,157 | 9/1975 | Wachtell et al. . |
| 4,288,677 | 9/1981 | Sakata et al. . |
| 4,509,238 | 4/1985 | Lee et al. . |
| 4,643,636 | 2/1987 | Libertini et al. . |
| 4,655,682 | 4/1987 | Kunz et al. . |
| 4,728,258 | 3/1988 | Blazek et al. . |
| 5,017,091 | 5/1991 | Tran . |

*Primary Examiner*—John T. Kwon
*Attorney, Agent, or Firm*—Nixon & Vanderhye

[57] ABSTRACT

A nozzle diaphragm for a turbine includes an outer ring having a groove formed along its inner surface for receiving a first locator ring, an inner web having a groove formed along its outer surface for receiving a second locator ring and partitions circumferentially spaced one from the other and connected to the outer ring and inner web. The locator rings have slots opening into the flow region for receiving tenons formed on the ends of the partitions. By precisely locating the tenons and slots, the aerodynamic characteristics of the partitions can be set during fabrication without the need for expensive and time-consuming fixtures.

10 Claims, 8 Drawing Sheets

32
O.R.
16
12
18
22
23
30
10
25
28
24
20
I.W.
14

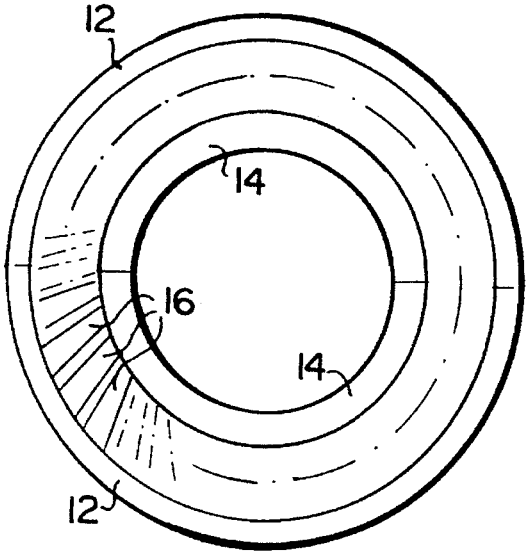
FIG. 5
FIG. 3
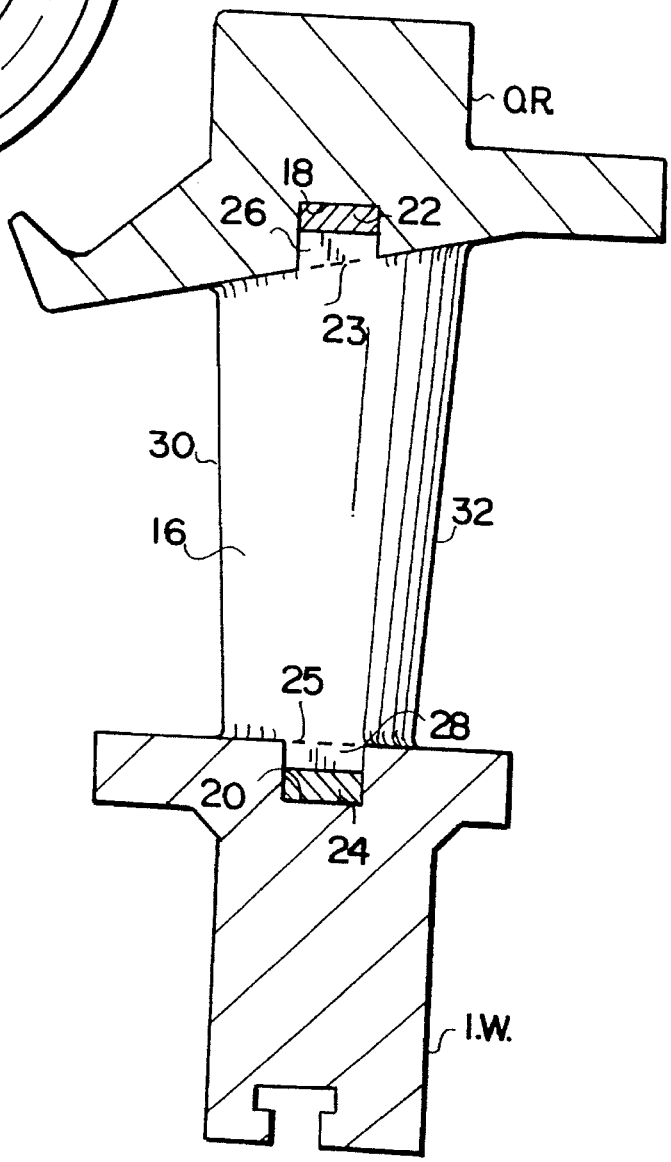
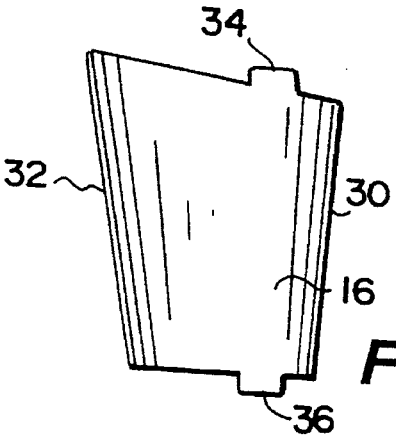
FIG. 4

48b
O.R.
16b
46b
12b
22b
30
10
40b
24b
I.W.
14b

TURBINE NOZZLE DIAPHRAGM AND METHOD OF ASSEMBLY

RELATED APPLICATIONS

This application is a continuation-in-part of U.S. patent application Ser. No. 08/280,899, filed Jul. 27, 1994, now abandoned.

TECHNICAL FIELD

The present invention relates to a nozzle diaphragm for a turbine and particularly to apparatus and methods for orienting airfoil-shaped partitions in a nozzle diaphragm for a turbine to accurately establish the location of the partitions relative to the inner web and outer ring whereby precision assembly and fabrication of the nozzle diaphragm can be accomplished without expensive, often one-time use, fixtures.

BACKGROUND

In the turbine industry, there have generally been two primary ways to fabricate nozzle diaphragms for turbines. The first is to fabricate the steam path subassembly of the nozzle diaphragm by securing the airfoil-shaped partitions to inner and outer spacer bands and subsequently securing that subassembly into the nozzle diaphragm. The second method is to fabricate the steam path directly into the outer ring and inner web segments. These are commonly referred to as fillet-type turbine nozzle diaphragms. The fabrication process in both cases is completed usually by welding. One such method is described and illustrated in U.S. Pat. No. 4,509,238 of common assignee herewith. Additionally, individual partitions have been set into an array inside a casting core box and the ring and web segments have been cast about the partition ends to form a completed nozzle diaphragm half.

To fabricate fillet-type turbine nozzle diaphragms, expensive fillet fabrication fixtures are typically employed. The fixtures require the nozzle diaphragm design cycle to be advanced to allow time for the design and manufacture of the fixtures prior to the actual manufacture of the nozzle diaphragm. Fillet fabrication fixtures that have been used in the past to position the individual partitions relative to the outer ring and inner web segments of the nozzle diaphragms are typically only useful for a single design. Thus, for one-of-a-kind replacement nozzle diaphragms or a minimum number of replacement nozzle diaphragms, the fixture cost is often too high to economically replace the nozzle diaphragm.

DISCLOSURE OF THE INVENTION

In accordance with the present invention, there is provided a nozzle diaphragm assembly and fabrication techniques for turbines which essentially eliminate the need for expensive prior art fixtures for making filleted nozzle diaphragms and provides nozzle diaphragm assemblies and methods of assembly which afford precision reference surfaces for orienting the partitions in the finished nozzle diaphragm and substantial savings in cycle time for the manufacture of the nozzle diaphragm. More particularly, and in a first embodiment of the present invention, unique end configurations for the partitions are fabricated for precision mating with slots formed in locator insert rings precision-fit into grooves in respective outer ring and inner web segments. This combination of partition end configuration, locator insert rings with slots and inner web and outer ring locator grooves enables precision assembly and fabrication of the nozzle diaphragm without need for expensive, oftentimes one-of-a-kind, fixtures.

Specifically, the outer ring segment is provided with a precision groove along its inner surface, while the inner web segment is provided with a similar precision groove along its outer surface. (It will be appreciated that the outer ring and inner web are formed of arcuate segments, usually 180° and subsequently assembled to form the finished nozzle diaphragm.) First and second locator ring segments are inserted into these grooves, respectively. For example, the first locator ring segment is disposed in the groove of the outer ring segment and the slots of the first locator ring segment open substantially radially inwardly, while portions of the locator ring segment between the slots lie flush with the inner surface of the outer ring. The second locator ring segment is disposed in the groove in the outer surface of the inner web segment and has slots opening generally radially outwardly with portions between those slots lying flush with the outer surface of the inner web segment. Locator tabs or tenons are provided on each of the opposite ends of the partitions. These locator tenons are precision-formed and mate precisely with the locator slots in the respective locator rings. The combination of the locator rings, locator slots, outer ring and inner web grooves and the partitions with the integral locator tenons precisely set the axial location, axial and tangential lean and the setback of the partitions, as well as the throat and pitch of the partitions in final assembly of the nozzle diaphragm. For example, once the tenons have been accurately formed on the opposite ends of elements forming the partitions, the elements can be fabricated or machined to form partitions to a precise shape with reference to the tenons whereby, in assembly, the partitions are accurately and precisely oriented with the nozzle diaphragm. Hence, the throat, pitch and nozzle area of the partitions can be changed by machining the partitions relative to the tenons to achieve the precise airfoil configuration and nozzle diaphragm aerodynamics desired.

To assemble the nozzle diaphragm, the first locator ring segment is inserted into the groove of the outer ring segment and secured, for example, by tack-welding. The tenons on the outer ends of the partitions are then disposed in the complementary-shaped slots of the first locator ring segment. The second locator ring segment is then displaced axially onto the tenons along the inner ends of the partitions. Subsequently, the inner web segment can be either axially rotated or displaced generally radially outwardly to receive the inner ring segment in its groove. Once assembled, the partitions can be welded to the outer ring and inner web segments, using fillet-type welds. The two generally semicircular nozzle diaphragm halves are then secured to one another to complete the nozzle diaphragm. It will be appreciated that the orientation of the slots on the locator rings and the tenons on the partitions can be reversed such that slots are provided on the partitions and tenons on the locator ring segments.

In another embodiment of the present invention, precision drilled holes are formed in the locator rings for the inner web and outer ring of the nozzle diaphragm for receiving pins which connect the partitions to the locator rings. In particular, the holes in the outer locator ring receive pins attached to the outer ends of the partitions, while the holes in the inner locator ring extend entirely therethrough to receive pins which are driven through the inner locator ring holes from the outside into mating precision holes formed in the inner ends of the partitions. This allows the partitions to be secured to the locator rings prior to insertion of the locator rings into the grooves formed in the inner web and outer ring of the steam path. It will be appreciated that the function of the locator rings can be reversed such that the locating ring with the holes extending completely therethrough for receiving pins inserted from the backside is the outer locating ring. Preferably, a pair of pins are provided at each of the opposite ends of each nozzle partition, although a pair of pins at one end and a single pin at the opposite end may be utilized. With this lo construction, the partitions can be readily secured to the locator rings and the locator rings, in turn, readily secured to the inner web and outer ring of the steam path. Fillet welding would then be applied about the juncture of the partitions and the inner web and outer ring to complete the steam path. As an alternative, precision holes may be drilled directly into the inner web or outer ring without the use of one of the locator rings. In both instances, the pins are not secured but are placed to hold the assembled nozzle partitions, inner web, outer ring and locator rings, where utilized, in relation to one another until fillet welded. Of course, if the holes are provided in the inner web or outer ring directly, locator grooves are not necessary for the other of the inner web and outer ring.

In a preferred embodiment according to the present invention, there is provided a nozzle diaphragm for use in a turbine comprising an outer ring having a groove formed along an inner surface thereof, an inner web having a groove formed along an outer surface thereof, a first locator ring received in the groove formed along the outer ring and having a plurality of circumferentially spaced slots opening generally radially inwardly of the outer ring, and a second locator ring received in the groove formed along the inner ring and having a plurality of circumferentially spaced slots opening generally radially outwardly of the inner ring. A plurality of generally circumferentially spaced partitions are provided between the outer ring and the inner web, each partition having inner and outer ends and a tenon projecting from the ends for reception within the slots of the inner and outer locator rings, respectively, to locate each partition in the nozzle diaphragm.

In a further preferred embodiment according to the present invention, there is provided a nozzle diaphragm for use in a turbine comprising an outer ring, an inner web, a first locator ring carried by the outer ring and having a plurality of circumferentially spaced, radially extending first connection areas, a second locator ring carried by the inner web and having a plurality of circumferentially spaced, radially extending second connection areas and a plurality of generally circumferentially spaced partitions between the outer ring and the inner web, each partition having a connection area at an outer end thereof complementary in shape to the first connection area and a connection area at an inner end thereof complementary in shape to the second connection area for establishing the axial location, the axial and tangential lean, the setback, and the throat and pitch of the partitions relative to the outer ring and the inner web.

In a further preferred embodiment according to the present invention, there is provided a nozzle diaphragm for use in a turbine, comprising an outer ring, an inner web, a plurality of generally circumferentially spaced partitions between the outer ring and the inner web, each partition having at each end thereof one of a projection and a recess complementary in shape to the projection, each outer ring and inner web having another projection and recess for establishing the axial location, the axial and tangential lean, the setback, and the throat and pitch of the partitions relative to the outer ring and the inner web when the projections are disposed in the complementary recesses, In a still further preferred embodiment according to the present invention, there is provided a method of manufacturing a nozzle diaphragm for a turbine comprising the steps of providing an inner web segment and an outer ring segment, providing a plurality of partitions each having an outer end, an inner end, an airfoil section between the outer and inner ends, and tenons projecting from the outer and inner ends, forming a generally circumferentially extending groove along an inner surface of the outer ring segment and a generally circumferentially extending groove along an outer surface of the inner web, providing a first locator ring segment having circumferentially spaced slots opening radially inwardly thereof, disposing the first locator ring segment in the groove of the outer ring segment with the slots opening radially inwardly of the outer ring segment, inserting the tenons of the outer ends of the partitions in the slots, providing a second locator ring segment having circumferentially spaced slots opening radially outward thereof, relatively displacing the inner ends of the partitions and the second locator ring segment in a generally axial direction to dispose the tenons on the inner ends of the partition in the slots of the second locator ring segment and relatively displacing the inner web segment and the second locator ring segment to locate the second locator ring segment in the groove of the inner web segment, In a still further preferred embodiment according to the present invention, there is provided a method of orienting partitions of a nozzle diaphragm for a turbine relative to an inner web segment or an outer ring segment forming part of the nozzle diaphragm, comprising the steps of forming a plurality of radially extending slots or projections at circumferentially spaced locations about the inner web segment or the outer ring segment, forming on an end of each of a plurality of partitions a slot or projection sufficiently complementary in shape to the projections or slots, respectively, formed on the inner web segment or outer ring segment such that, upon engagement of complementary slots and projections, each slot or projection on each partition end is oriented relative to its complementary slot or projection and forming each partition identically to each other partition and relative to the slot or projection on the end of the partition to establish the axial location, the axial and tangential lean, and the throat and pitch of the partitions relative to the inner web segment or outer ring segment.

Accordingly, it is a primary object of the present invention to provide a novel and improved nozzle diaphragm assembly and method of fabricating a nozzle diaphragm for a turbine.

BRIEF DESCRIPTION OF THE DRAWINGS

FIG. 3 is a cross-sectional view through the outer ring and inner web segments of a nozzle diaphragm illustrating the locator ring segments and a partition therebetween;

FIG. 4 is a side elevational view of a partition on a reduced scale illustrating the tenons on the opposite ends of the partition;

FIG. 5 is a schematic end elevational view of a completed nozzle diaphragm;

BEST MODE FOR CARRYING OUT THE INVENTION

Figure 1:
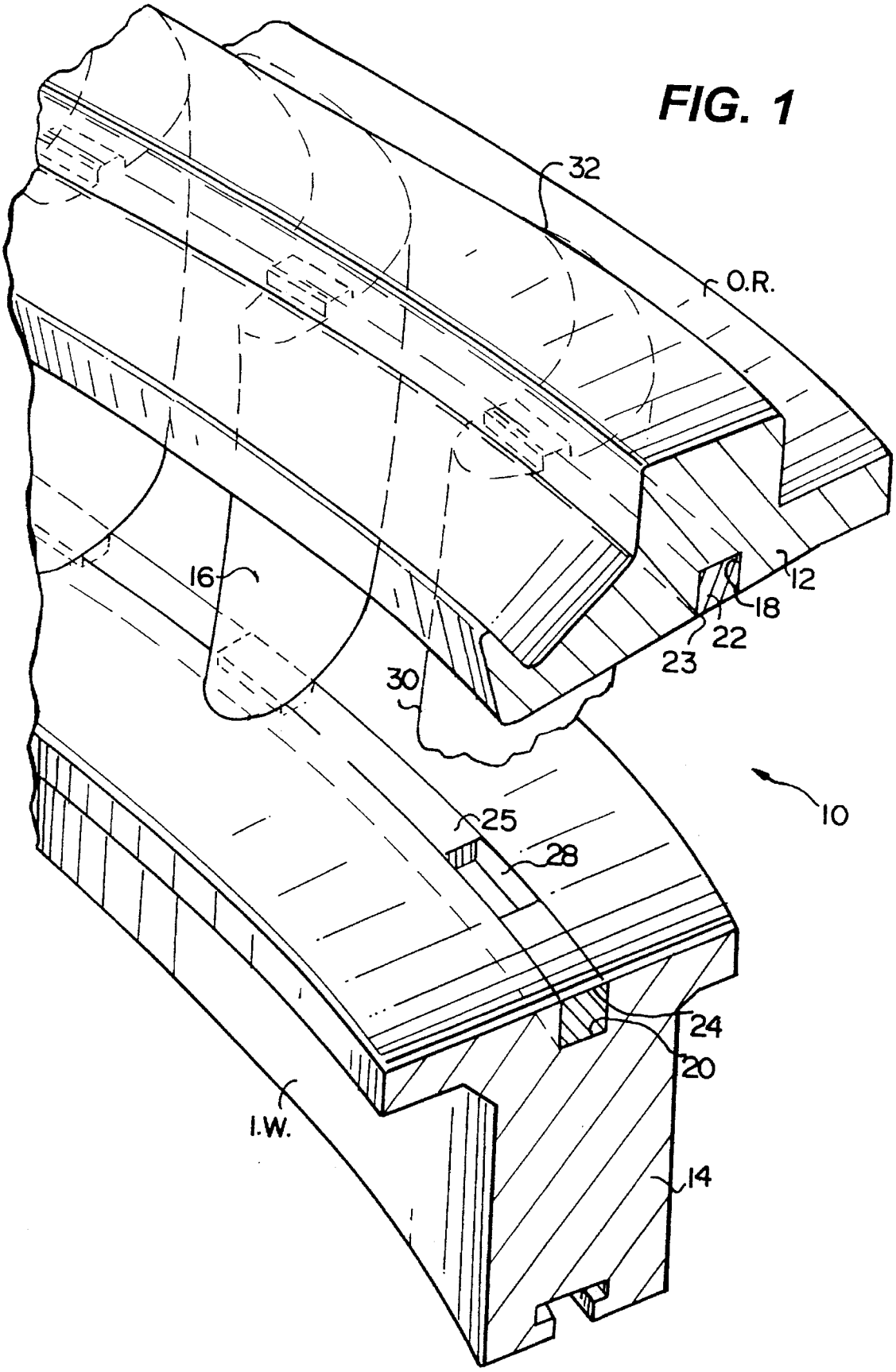
FIG. 1 is a fragmentary perspective view with parts in cross-section of an outer ring segment and an inner web segment with locator rings and partitions between the segments.

Referring now to FIG. 1, there is illustrated a nozzle diaphragm, generally designated 10, for use with a turbine and including an outer ring O.R., an annular inner web I.W. and a plurality of stator vanes or airfoil-shaped partitions 16 connected at opposite ends between the outer ring and inner web and spaced circumferentially one from the other about the nozzle diaphragm. It will be appreciated that each of the outer ring and inner web are provided in segments 12 and 14, respectively, preferably two segments each equal to one-half the circumference of the nozzle diaphragm as illustrated in FIG. 5. As illustrated, the outer ring segment 12 includes a groove 18 formed along an inner surface thereof and extending circumferentially about the inner surface of outer ring segment 12. Inner web segment 14 also includes a groove 20 formed along an outer surface thereof and extending circumferentially about the outer surface of inner web segment 14. In accordance with the present invention, a first locator ring segment 22 is received in the groove 18 formed within outer ring segment 12. The locator ring segment 22 has opposite side walls precisely formed for fitting between the registering side walls of the groove 18. As illustrated in FIG. 3, the exposed inwardly directed surface 23 of the first locator ring segment 22 lies flush with the inner surface of the outer segment ring 12.

Similarly, a second locator ring segment 24 is disposed in the groove formed along the inner web segment 14. The side walls of the second locator ring segment 24 are likewise precisely fitted with the registering side walls of the groove 20. The exposed outwardly directed surface 25 of the second locator ring segment 24 lies flush with the outer surface of the inner web segment 14.

Figure 2:
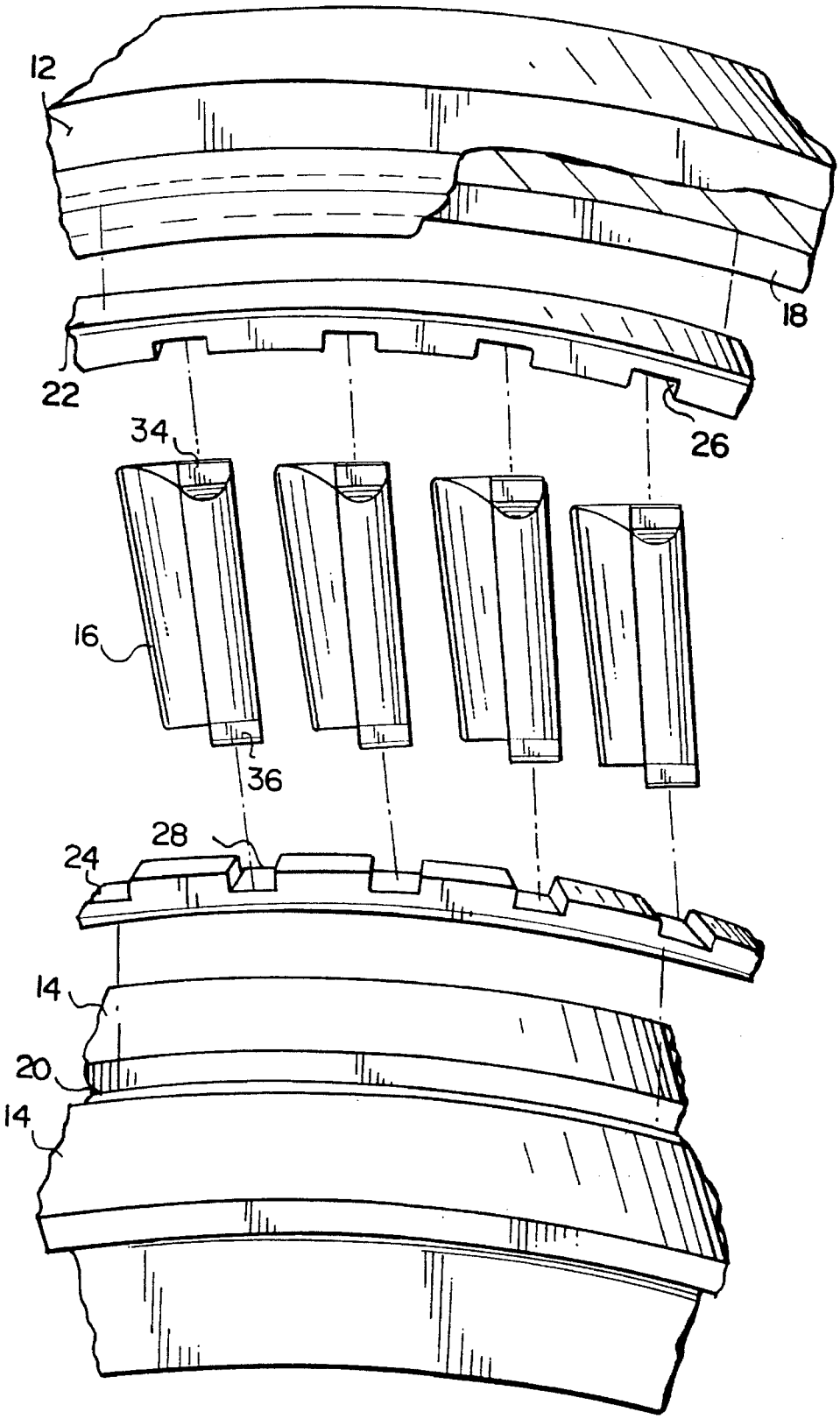
FIG. 2 is a fragmentary exploded perspective view with parts in cross-section illustrating the arrangement of the elements forming the nozzle diaphragm.

Each of the first and second locator ring segments has a plurality of slots 26 and 28, respectively, formed along their exposed surfaces as is best shown in FIG. 2. For example, the first locator ring segment 22 includes a plurality of slots 26 spaced circumferentially one from the other with the slots preferably extending in an axial direction and opening in a generally radially inward direction. The second locator ring 24 likewise has a plurality of slots 28 spaced circumferentially one from the other and similarly extending in an axial direction. Slots 28 open in a generally radial outward direction. As discussed hereafter in connection with the assembly of the nozzle diaphragm, the slots 26 and 28 are precisely formed, for example, by machining precise surfaces, and the locator ring segments 22 and 24 are disposed at precise locations in the outer ring segments 12 and inner web segments 14, respectively, to accurately orient and fit the partitions 16.

As illustrated, each partition 16 is generally in the form of an airfoil having leading and trailing edges 30 and 32, respectively. Each partition 16 includes a pair of tenons or tabs 34 and 36 projecting from respective opposite ends. The tenons 34 and 36 are precisely formed for fitting within respective ones of the slots of the locator ring segments. It will be appreciated that in the final assembly of the outer ring segment, inner web segment, first and second locator ring segments and the partitions that the tenons on the partitions and the slots on the locator ring segments will precisely set the partition's axial location, axial and tangential lean, setback and the nozzle diaphragm's throat and pitch. It will also be appreciated that the tenons 34 and 36 and slots 26 and 28 form respective connection areas with one another and that the tenons and slots may be reversed in location, i.e., the tenons may be located on the locator rings to project radially beyond the hot gas path surfaces of the outer ring and inner web for reception in complementary slots formed in the ends of the partitions.

To assemble the nozzle diaphragm, and as an initial step, the first locator ring segment 22 is disposed in the groove 18 of the outer ring segment 12 and preferably tack-welded in precise location with the inner exposed surface 23 of the locator ring segment 22 lying flush with the inner surface of the outer ring segment 12. The outer tenons 34 of the partitions 16 are then inserted into the slots 26 of the first locator ring segment 22. It will be appreciated that because the tenons and slots are precisely formed, the partitions 16 are thus precisely located axially and tangentially. Moreover, the partition's setback and the nozzle diaphragm's throat and pitch, as well as axial and tangential lean, are similarly set because of the precision formation of the partitions relative to the tenons and the tenons relative to the slots, as well as the engagement of the ends of the partitions against the inner surface of the outer ring segment.

Once the partitions have been secured to the outer ring segment, for example, by tack-welding, the inner or second locator ring segment 24 is located on the tenons 36 at the opposite end of the partitions. Particularly, the inner locator ring segment 24 is displaced axially relative to the partition 16 such that the tenons 36 are received in the axially opening slots 28. Once positioned in the slots, the locator ring segment 24 may be tack-welded to the partitions 16 to maintain it in place. The second locator ring 24 and inner web segment 14 are then relatively displaced such that the second locator ring 24 is received in the groove 20 of the inner web segment 14. This is accomplished by either rotating the inner web segment 14 about the axis of the nozzle diaphragm such that the second locator ring segment 24 is received in the slot 20 or by pushing the inner web segment 14 radially outwardly onto the second locator ring segment 24 such that it is received in the slot 20. Each of the partitions 16 is fillet-welded at its opposite ends to the outer ring and inner web segments, respectively, with the semicircular segments of the nozzle diaphragm being later joined together to complete the full nozzle diaphragm as illustrated in FIG. 5.

Figure 6:
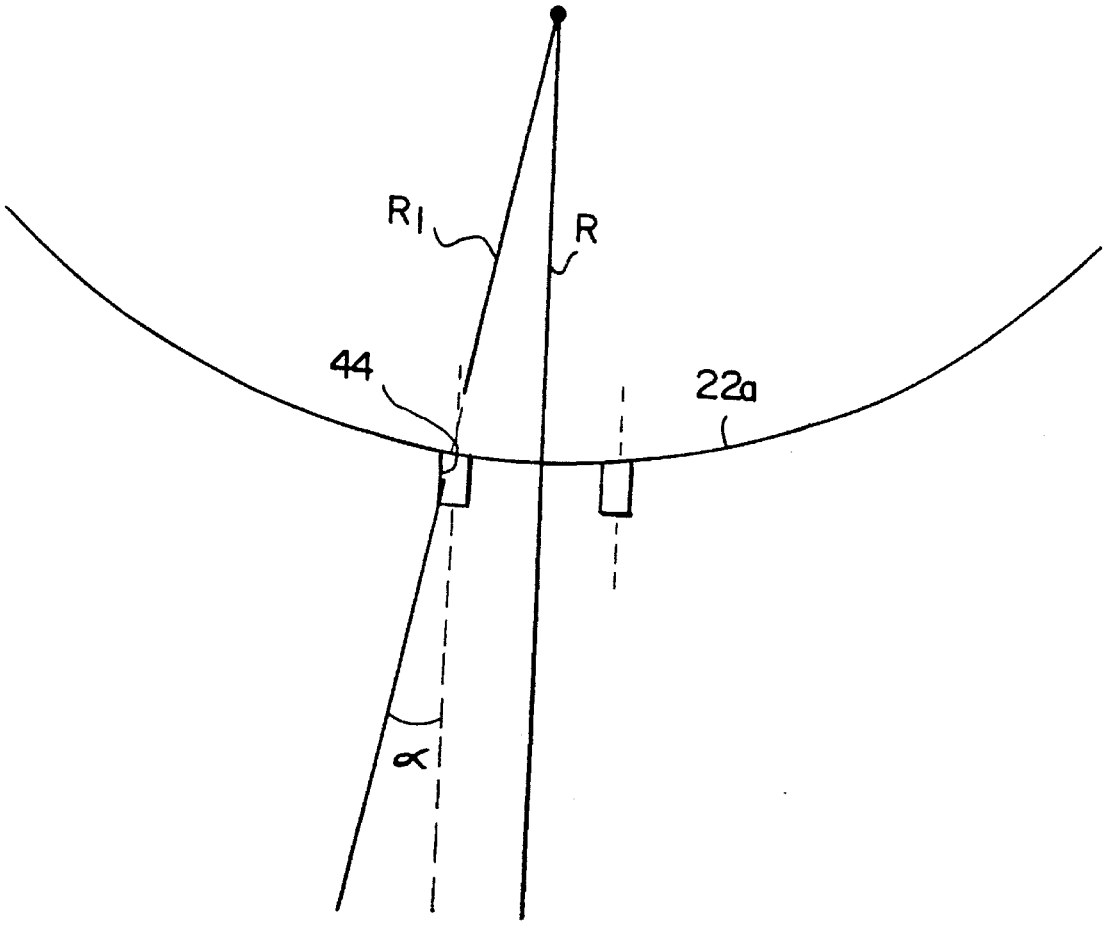
FIG. 6 is a schematic representation illustrating the location of the precision holes for receiving the pins in a second embodiment of the turbine nozzle diaphragm and method of assembly thereof.
Figure 7:
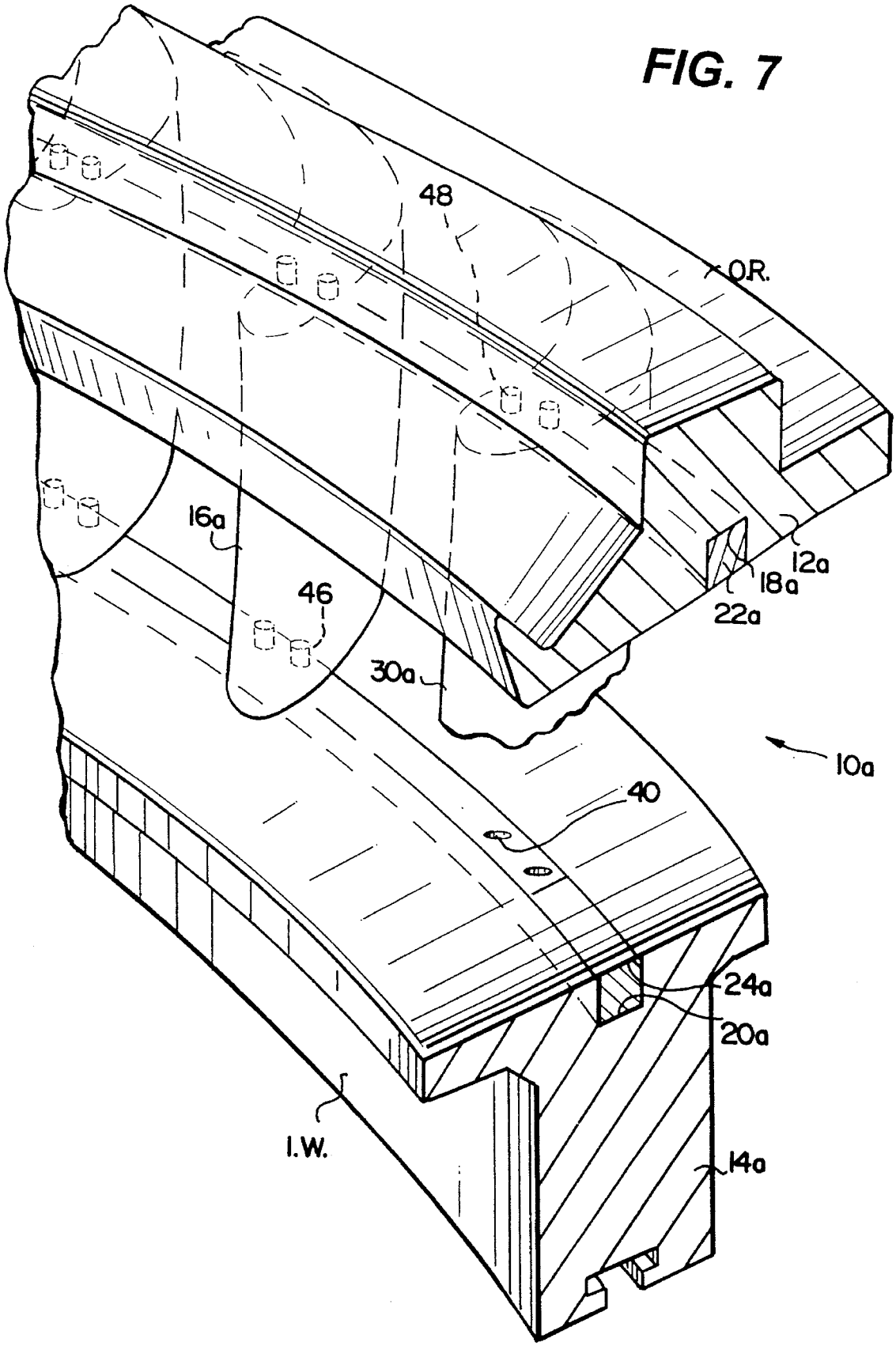
FIG. 7 is a fragmentary perspective view with parts in cross-section illustrating attachment of the partitions to the locator rings, in turn disposed in the inner web and outer ring, respectively.
Figure 8:
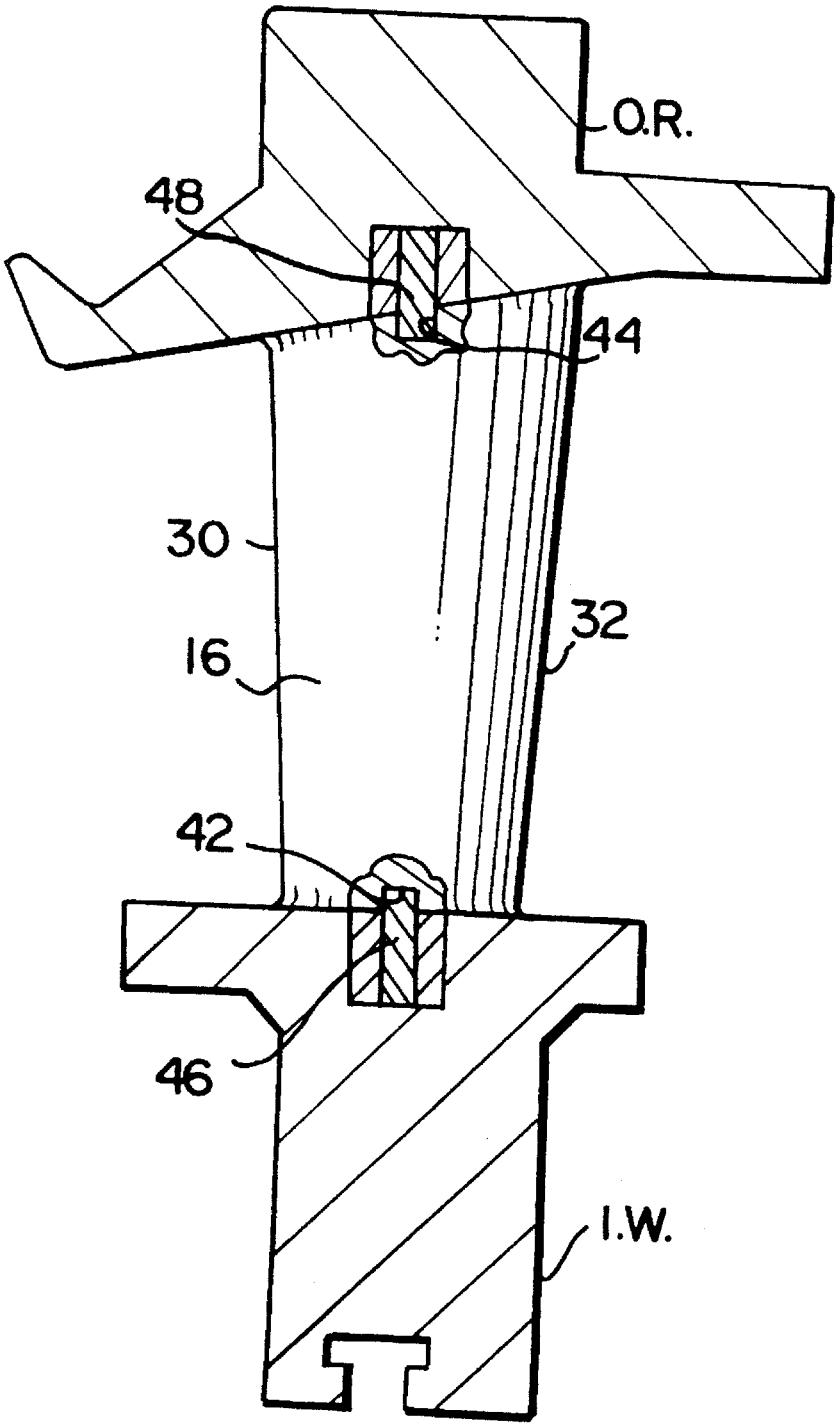
FIG. 8 is a cross-sectional view of the nozzle diaphragm illustrating the pinned coupling between the partitions and the inner web and outer ring locator rings.

Referring now to the embodiments hereof illustrated in FIGS. 6–8, wherein like reference numerals apply to like parts, followed by the suffix "a," there is illustrated an inner web and an outer ring having a plurality of stator vanes or partitions **16*a* for connection with an outer ring segment 12*a* and an inner web segment 14*a*. As in the prior embodiment, a groove 18*a* is formed along the radially inner face of the outer ring segment 12***a* and a groove 20*a* is formed along the outer face of the inner web 14*a*, the grooves 18*a* and 20*a* being disposed to receive first and second locator ring segments 22*a* and 24*a*.

Instead of tenon and groove connections between the partitions and the locator rings as in the first embodiment of FIGS. 1–5, the locator rings are provided with precision-drilled holes at circumferentially spaced positions about the nozzle diaphragm. Preferably, two holes 40 are provided at each location of a partition 16*a* for locating the partition in relation to the locator rings 22*a* and 24*a*. While preferably two precision holes are formed at each partition location along the locator rings, one ring may have only one drilled hole for each partition, provided the opposite ring has at least a pair of such precision-drilled openings. Likewise, co-linear precision-drilled holes are formed in the opposite ends of the partitions, for example, at 42 and 44 (FIG. 8). The holes in the partitions and the holes in the locator rings are accurately, precisely aligned with one another. Preferably, as illustrated in FIG. 6, the holes in the partitions and locator rings are formed along axes parallel to a radial line between the axes of the holes. Thus, the axes of the holes 44 along the locator ring 22*a* lie parallel to a radius R extending halfway between the openings and, hence, the axes of the openings diverge by an angle $\alpha$ from a radius R1 through the hole 44. It is, of course, possible to form radial holes, though the parallel holes are preferred.

Figure 9:
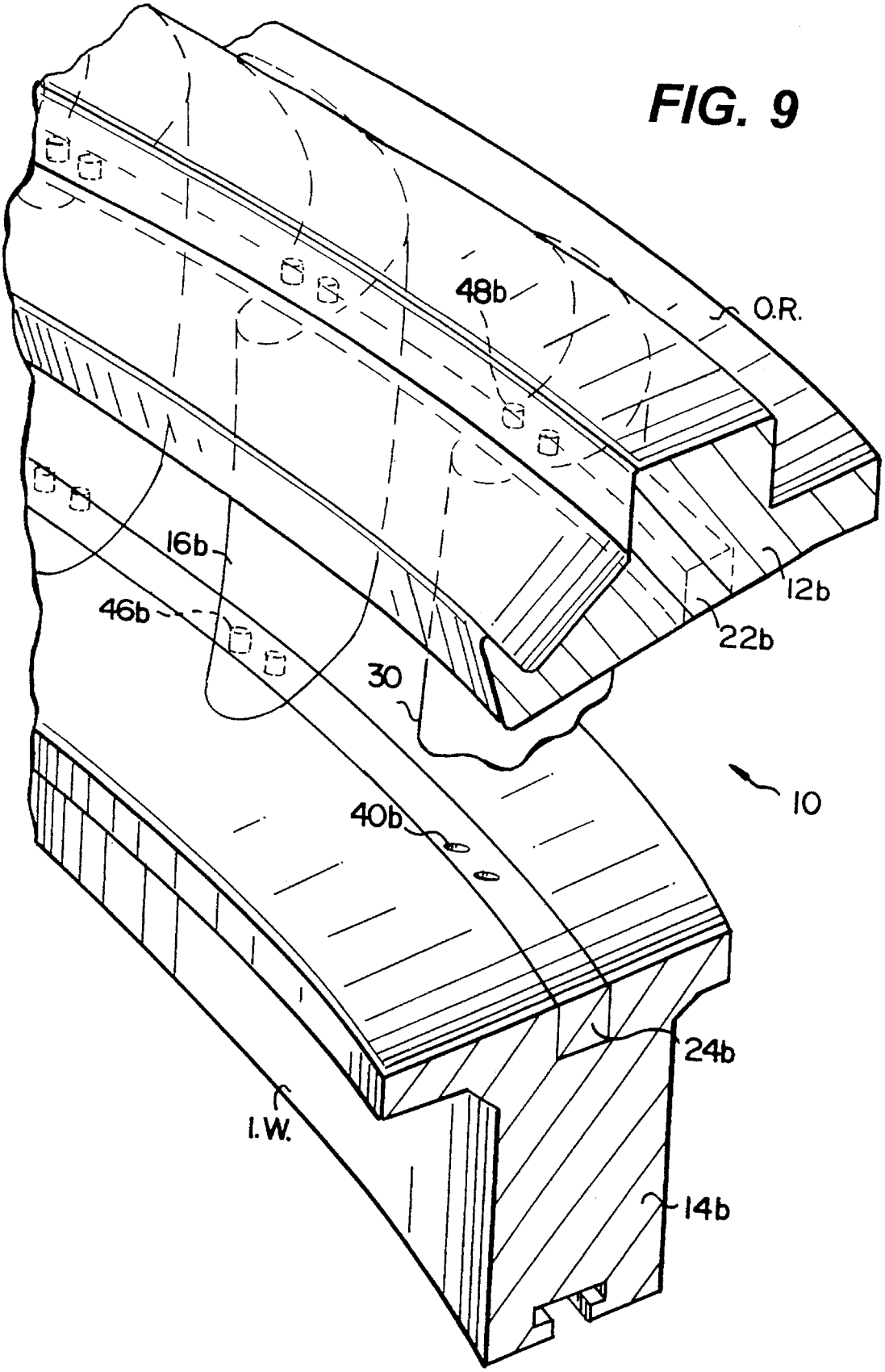
FIG. 9 is a view similar to FIG. 7 illustrating a further form of coupling between the partitions and the inner web or outer ring.
Figure 10:
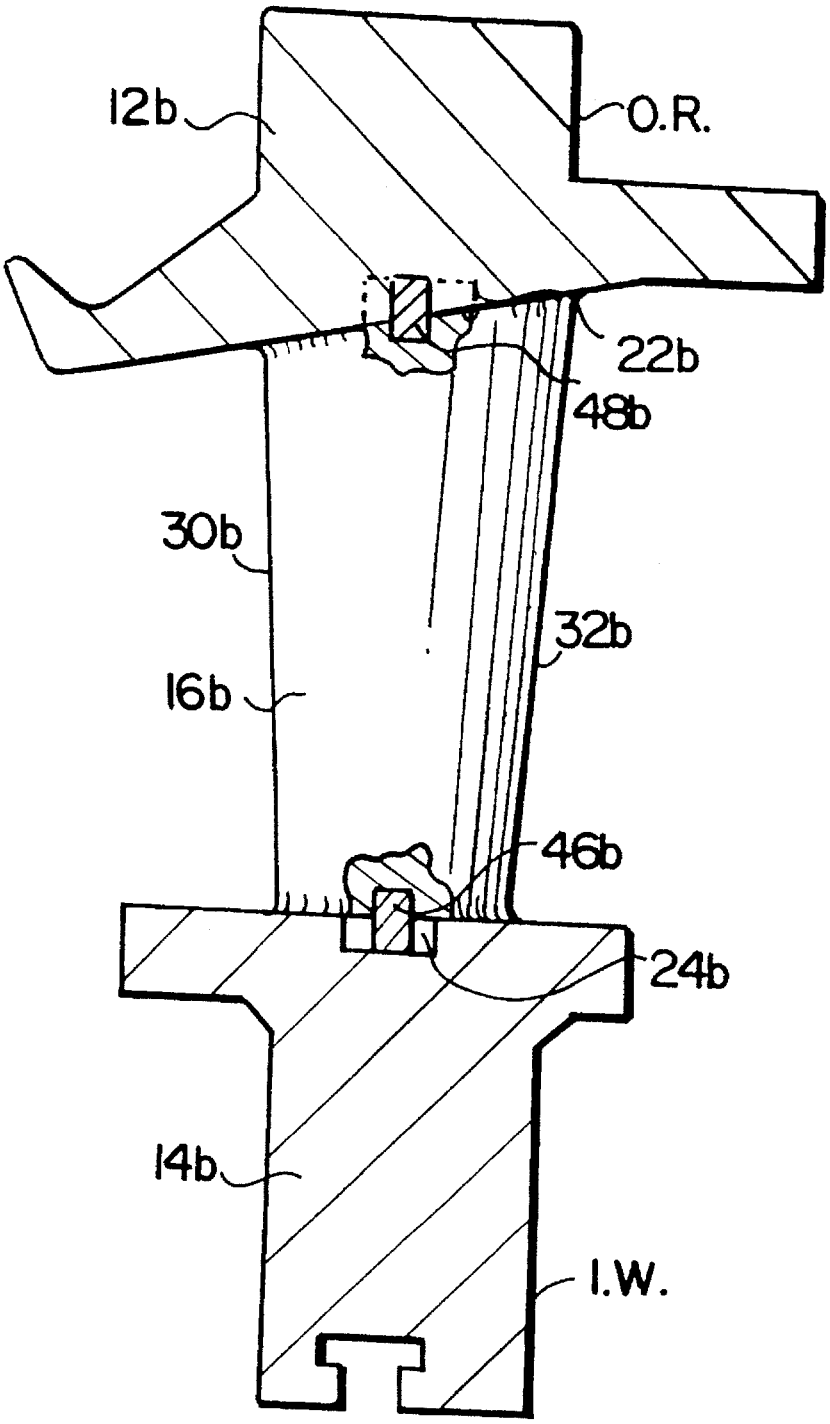
FIG. 10 is a view similar to FIG. 8 illustrating the pin connection between the partitions and inner web or outer ring of the embodiment hereof illustrated in FIG. 9.

Pins 46 and 48 are disposed in the holes 42 and 44 of the locator rings. Necessarily, the precision holes of either the inner or outer locator rings must extend entirely through the locator ring to enable assembly. In one embodiment, with the holes 40 extending completely through the inner locator ring 24*a*, the holes in the outer locating ring first receive the pins 48 connecting the radially outer ends of partitions 16*a* to the outer locator ring 22*a*. Thereafter, pins are driven through the holes in the inner locator ring 24*a* from the radially inner side thereof into the aligned holes at the radially inner ends of partitions 16*a*. In a similar manner, the function of the locator rings can be reversed so that the outer locator ring is the one with the holes extending completely therethrough, and being the last to receive its pins, driven from the radially outer side thereof. It will be appreciated that the pins temporarily secure the partitions to the locator rings in a sub-assembly, while the inner and outer locator rings are being assembled in the inner web and outer ring, respectively. This configuration thus enables the partitions to be precisely located relative to the locator rings, which are in turn precisely located relative to the inner web and outer ring whereby the partitions are accurately placed in axial location, rotation, circumferential lean, etc. To complete the assembly, the partitions are fillet-welded at the juncture of the partitions with the inner web and outer ring as in the prior embodiment. Referring now to FIGS. 9 and 10, precision-drilled holes 40*b*may be formed along the outer surface of the inner web 14*b*, or along the inner surface of the outer ring 12*b*. In this form, the precision-formed grooves extending circumferentially about the inner web or outer ring, as well as the associated locator ring segment, may be entirely eliminated. Thus, the partitions 16*b* may be pinned directly to the inner web 14*b* or outer ring 12*b* by pins 46*b* or 48*b*, respectively. For example, as illustrated in FIGS. 9 and 10, the outer locator ring 22*b* (shown as dotted) may be eliminated, with the partitions 16*b* pinned directly to outer ring 12*b*. Alternatively, inner locator ring 24*b* (shown in solid) may be eliminated, with the partitions 16*b* pinned directly to inner web 14*b*. In either configuration, the partitions may then be fillet-welded at their juncture with the inner web and outer ring.

By precisely locating the locator ring segments in the grooves and forming the slots and tenons on the locator ring segments and partitions, respectively, or by using the precision holes and pin arrangements of the embodiments of FIGS. 6–8 and 9–10, respectively, the various parameters, such as axial location, axial and o tangential lean, setback and the throat and pitch of the partitions of the nozzle diaphragm are set. That is, proper partition orientation is achieved by the foregoing described fabrication without the need for expensive and time-consuming fixtures previously utilized in the fabrication of nozzle diaphragms. Additionally, certain parameters of the nozzle diaphragm using this fabrication technique can be readily changed. For example, to open or choke down the flow, or change the nozzle area, the partitions can be machined differently relative to the tenons or drilled holes to alter the characteristics of the nozzle diaphragm. Thus, to change the nozzle area, the rotation of the blade can be changed by machining the blade at a different angle relative to the tenon or pin holes and inserting the newly-machined blade into the nozzle diaphragm in accordance with the above-described fabrication technique.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle diaphragm for use in a turbine comprising:

an outer ring;

an inner web;

a circumferentially extending locator ring carried by one of said outer ring and said inner web, said locator ring including a plurality of circumferentially spaced holes through and extending between opposite radial sides thereof;

a plurality of partitions connected to and extending between said outer ring and said inner web, each of said partitions having an end adjacent said locator ring and an opening therein; and a plurality of pins, each said pin being received in and through a hole of said locator ring and extending therefrom into said opening in the end of a partition for locating said locator ring and said partitions.

2. A diaphragm according to claim 1 including a second locator ring carried by another of said outer ring and said inner web and having a plurality of circumferentially spaced holes, each of said partitions having another end adjacent said second locator ring and an opening therein, and pins received in said holes of said second locator ring and said openings of said another ends of said partitions for locating said second locator ring and said partitions.

3. A diaphragm according to claim 2 wherein a different number of pins are located at the opposite ends of the partitions.

4. A diaphragm according to claim 1 including means for locating said partitions at another end thereof adjacent and relative to another of said outer ring and said inner web.

5. A diaphragm according to claim 1 wherein said first locator ring is carried by said inner web, a second locator ring carried by said outer web, said second locator ring having a plurality of circumferentially spaced holes through and extending between opposite radial sides thereof, each of said partitions having another end adjacent said second locator ring and an opening therein, and pins received in and through said holes in said second locator ring and extending therefrom into said openings in said another ends of said partitions for locating said partitions and said outer ring.

6. A diaphragm according to claim 5 wherein one of said first and second locator rings includes a pair of holes through and extending between opposite radial sides thereof for each partition, an end of said partition adjacent said one locator ring having a pair of openings therein and pins received in and through said pair of holes of said one locator ring and extending therefrom into said pair of openings in said end of said partition.

7. A diaphragm according to claim 6 wherein the diaphragm is generally annular about an axis, axes of the pair of holes through said one locator ring lying parallel to a radius extending from said diaphragm axis substantially halfway between the holes whereby the axes of the holes do not intersect the diaphragm radius.

8. A diaphragm according to claim 7 wherein axes of said pair of openings in said end of said partition lie parallel to said radius and said radius extends substantially halfway between said pair of openings whereby the axes of said pair of openings do not intersect said radius.

9. A diaphragm according to claim 1 wherein a like number of pins are disposed at the opposite ends of the partition.

10. A diaphragm according to claim 1 wherein said partitions and said inner web are welded to one another and said partitions and said outer ring are welded to one another, said outer ring, said inner web and said locator rings each being formed in discrete, generally semi-circular segments with said inner web and said outer ring defining a common axis.

* * * * *